US008453633B2

(12) United States Patent
Tsai

(10) Patent No.: US 8,453,633 B2
(45) Date of Patent: Jun. 4, 2013

(54) SPRING-PISTON AIRSOFT GUN

(76) Inventor: Ching-Li Tsai, Chiayi (TW)

( * ) Notice: Subject to any disclaimer, the term of this patent is extended or adjusted under 35 U.S.C. 154(b) by 211 days.

(21) Appl. No.: 13/167,510

(22) Filed: Jun. 23, 2011

(65) Prior Publication Data

US 2011/0315134 A1 Dec. 29, 2011

(30) Foreign Application Priority Data

Jun. 25, 2010 (TW) ..... 099212110 U

(51) Int. Cl.
*F41B 11/00* (2006.01)

(52) U.S. Cl.
USPC ..... 124/66; 124/67; 124/68

(58) Field of Classification Search
USPC ..... 124/66, 65, 67, 68
See application file for complete search history.

(56) References Cited

U.S. PATENT DOCUMENTS 5,655,509 A * 8/1997 Casas Salva ..... 124/66
7,946,283 B2 * 5/2011 Lee et al. ..... 124/67
7,963,281 B2 * 6/2011 Pong ..... 124/67
8,297,269 B2 * 10/2012 Hu ..... 124/67
8,375,930 B2 * 2/2013 Gore ..... 124/66
2012/0216786 A1 * 8/2012 Hadley et al. ..... 124/66

* cited by examiner

*Primary Examiner* — J. Woodrow Eldred
(74) *Attorney, Agent, or Firm* — Banner & Witcoff, Ltd.

(57) ABSTRACT

A spring-piston airsoft gun includes a cylinder-and-piston assembly disposed in a barrel to force air through a muzzle end to make a shooting action, and a coil spring disposed to exert a biasing action to drive a piston head of the cylinder-and-piston assembly when changed from a compressed state to a released state. Front and rear anchor shanks are disposed for respectively mounting front and rear coil segments of the coil spring. A major shell and a minor ring are sleeved on the rear anchor shank to permit the coil spring to be sleeved thereon. The minor ring is in frictional contact with and angularly moveable relative to the major shell such that, when the coil spring is released to expand to the released state, the rear coil segment is tensed to drag the minor ring to angularly move therewith so as to minimize the frictional force therebetween.

9 Claims, 5 Drawing Sheets

SPRING-PISTON AIRSOFT GUN

CROSS-REFERENCE TO RELATED APPLICATION

This application claims priority of Taiwanese Utility Model Application No. 099212110, filed on Jun. 25, 2010, the disclosure of which is herein incorporated by reference.

BACKGROUND OF THE INVENTION

1. Field of the Invention

This invention relates to an airsoft gun, more particularly to a spring-piston airsoft gun.

2. Description of the Related Art

Airsoft guns used for recreation are generally powered by a piston compressing a pocket of air, and are classified into three types: gas-powered airsoft guns, spring-power airsoft guns, and automatic electric guns. Spring-powered airsoft guns and automatic electric guns are more popular in combat simulations and war games because they are safer.

Referring to FIG. 1, a conventional airsoft gun is shown to include a piston 12 which is loaded with a coil spring 13 and which is manually or automatically pulled backward to a rear chamber of a barrel 11 to compress the coil spring 13 to thereby cock the gun for firing. To stabilize expansion of the coil spring 13, an anchor member 14 is provided, which extends forwardly from a rear-gun end. A rear portion of the coil spring 13 is securely sleeved on the anchor member 14 such that, when the gun is triggered, the coil spring 13 is released to expand so as to drive the piston 12 forward, and the piston 12 in turn forces compressed air in the barrel 11 through a muzzle 15, thereby propelling plastic pellets (not shown). The anchor member 14 may be in the form of a shank 141, as shown in FIG. 2. The coil spring 13 is liable to seriously impact the shank 141, thereby causing great noises, wearing and heating of the shank 141, and twisting and deformation of the coil spring 13, which will in turn result in damage to the piston 12.

Referring to FIG. 3, another anchor member is proposed, which includes a shank 141 and a plastic sleeve 143 rotatably sleeved on the shank 141 so as to be rotated with the coil spring 13 to thereby minimize friction therebetween. However, no wear-resistant means is provided at two ends of the sleeve 143 where friction between the coil spring 13 and the sleeve 143 is relatively large.

SUMMARY OF THE INVENTION

An object of the present invention is to provide a spring-piston airsoft gun which has a spring guiding mechanism to ensure a noiseless, wear-resistant, and effective force transmission for making a shooting action.

According to this invention, the spring-piston airsoft gun includes a barrel extending along a stroke axis to terminate at a muzzle end and a gun-rear end, and defining an accommodation chamber which includes a front sub-chamber and a rear sub-chamber respectively proximate to the muzzle end and the gun-rear end. A cylinder is disposed in the front sub-chamber, and has a front end in fluid communication with the muzzle end, and an inner tubular wall surface extending rearwardly from the front end along the stroke axis. A piston member includes a piston head configured to be fittingly received in the cylinder and in slidable contact with the inner tubular wall surface, and a tubular wall extending rearwardly from the piston head along the stroke axis. A front anchor stem is disposed in the tubular wall, and extends from the piston head along the stroke axis. A rear anchor shank unit includes a core shank which is disposed in the rear sub-chamber and which extends forwardly from the gun-rear end along the stroke axis to terminate at a positioned end region, a major shell which is sleeved on the core shank proximate to the gun-rear end, and a minor ring which is sleeved on the core shank, which is in frictional contact with and angularly moveable relative to the major shell, and which is proximate to the positioned end region. A coil spring is disposed in the accommodation chamber to exert a biasing action to drive the piston head to force air through the muzzle end when the coil spring changes from a compressed state to a released state, and includes a front coil segment secured to the front anchor stem, and a rear coil segment which extends rearwardly from the front coil segment, and which is configured to be sleeved on the first minor ring and the major shell. When the coil spring is released to expand to the released state, the rear coil segment is tensed to drag the first minor ring to move therewith angularly and, by virtue of the angular moveability of the first minor ring, a frictional force between the rear coil segment and the first minor ring is minimized, thereby enhancing the wearability of the first minor ring.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
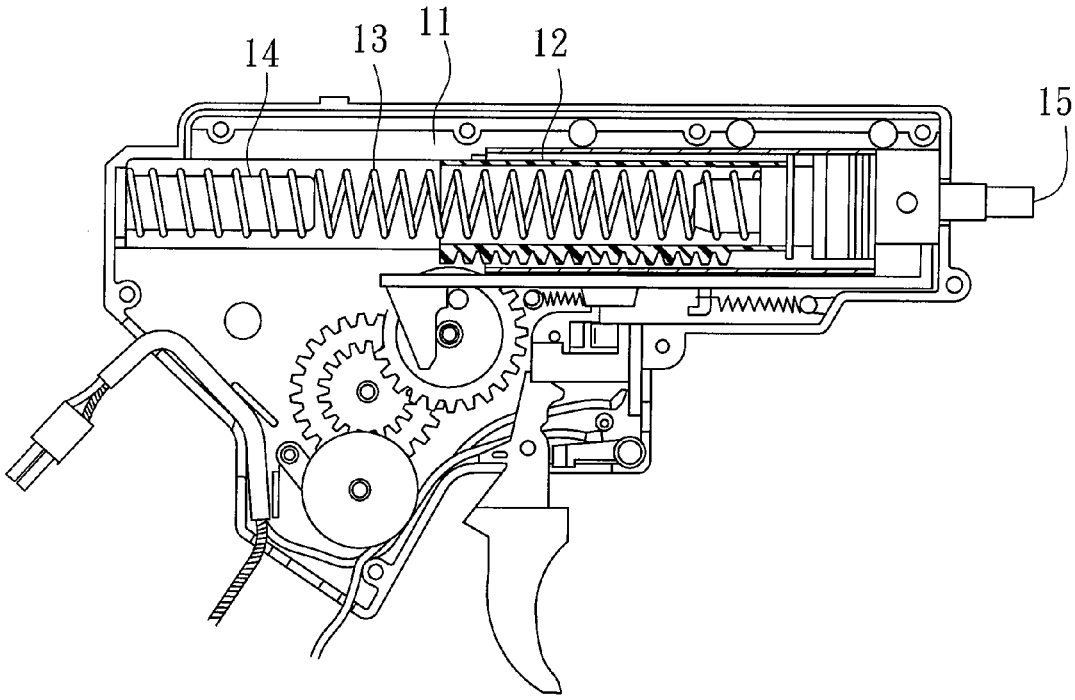
FIG. 1 PRIOR ART
FIG. 1 is a schematic sectional view of a conventional spring-piston airsoft gun.
Figure 2:
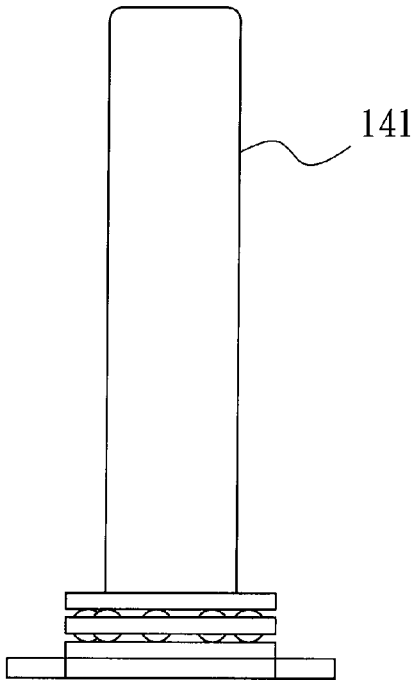
FIG. 2 PRIOR ART
FIG. 2 is a schematic side view of an anchor shank for mounting a coil spring of the conventional spring-piston airsoft gun.
Figure 3:
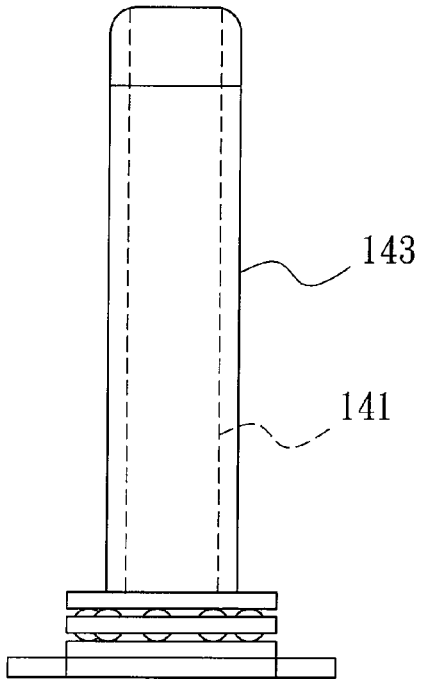
FIG. 3 PRIOR ART
FIG. 3 is a schematic side view of another anchor shank for the conventional spring-piston airsoft gun.
Figure 4:
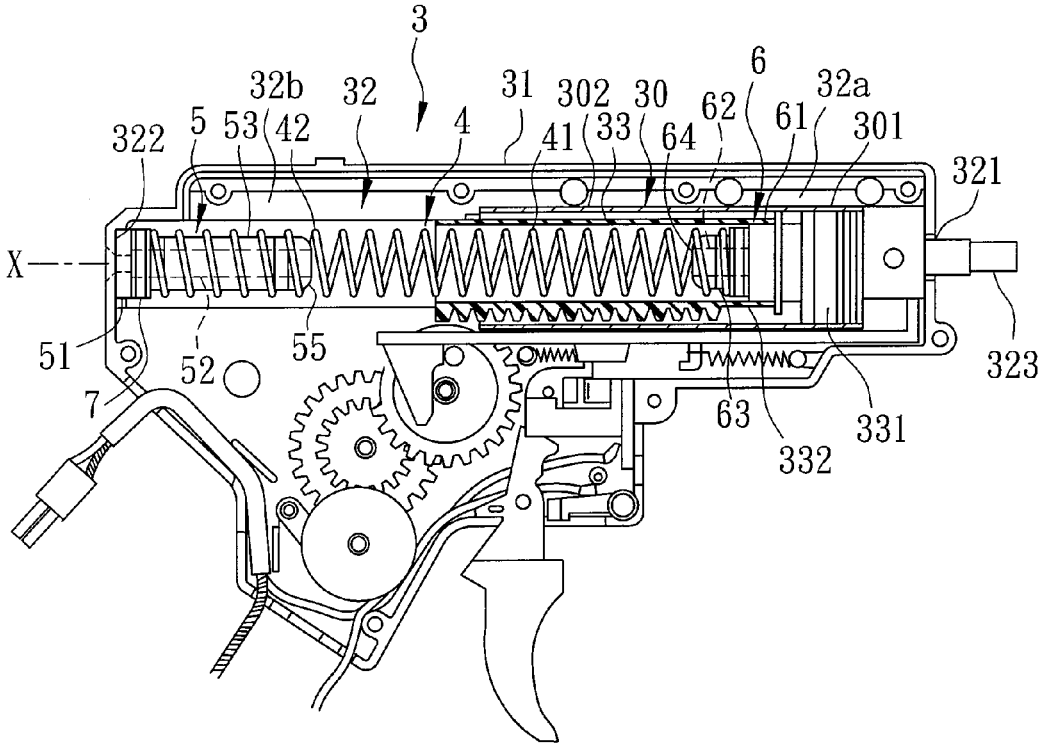
FIG. 4 is a schematic sectional view of the preferred embodiment of a spring-piston airsoft gun according to this invention.

Referring to FIG. 4, the preferred embodiment of a spring-piston airsoft gun 3 according to the present invention is shown to comprise a barrel 31, a cylinder 30, a piston member 33, a spring guiding mechanism, and a coil spring 4. The airsoft gun 3 further comprises a magazine, a trigger, a gear box, a drive motor, etc. Since the structure of those component parts is of a hitherto known type, a description is not provided.

The barrel 31 extends along a stroke axis (X) to terminate at a muzzle end 321 and a gun-rear end 322, and defines an accommodation chamber 32 which includes a front sub-chamber (32*a*) and a rear sub-chamber (32*b*) respectively proximate to the muzzle end 321 and the gun-rear end 322. The cylinder 30 is disposed in the front sub-chamber (32*a*), and has a front end 301 in fluid communication with the muzzle end 321, and an inner tubular wall surface 302 that extends rearwardly from the front end 301 along the stroke axis (X).

The piston member 33 includes a piston head 331 configured to be fittingly received in the cylinder 30 and in slidable contact with the inner tubular wall surface 302 such that, when driven forward, the piston head 331 forces air through a muzzle 323 on the muzzle end 321 to make a shooting action, and a tubular wall 332 which extends rearwardly from the piston head 331 along the stroke axis (X).

Figure 5:
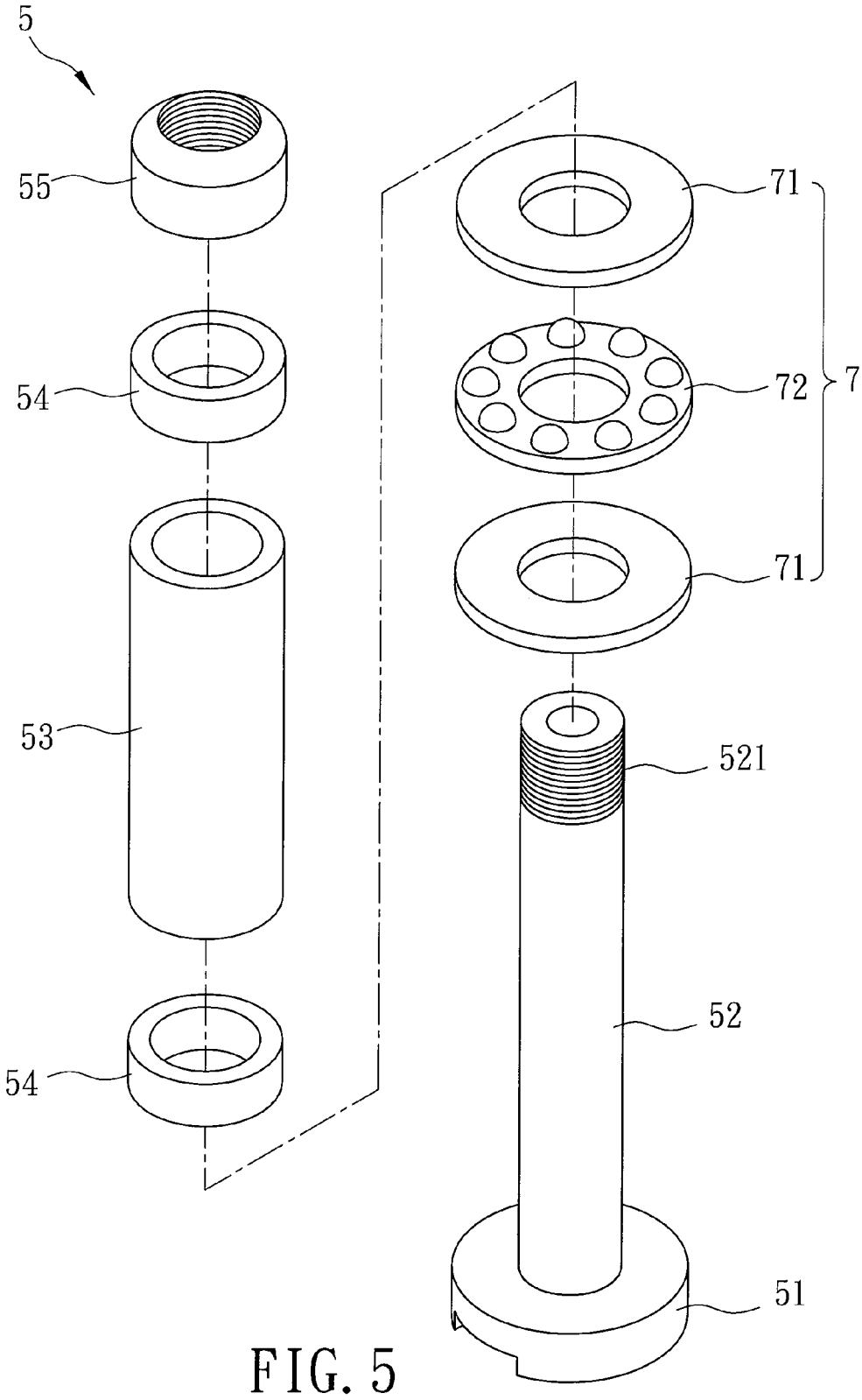
FIG. 5 is an exploded perspective view of an anchor shank unit and a bearing unit of a spring guiding mechanism of the preferred embodiment.
Figure 6:
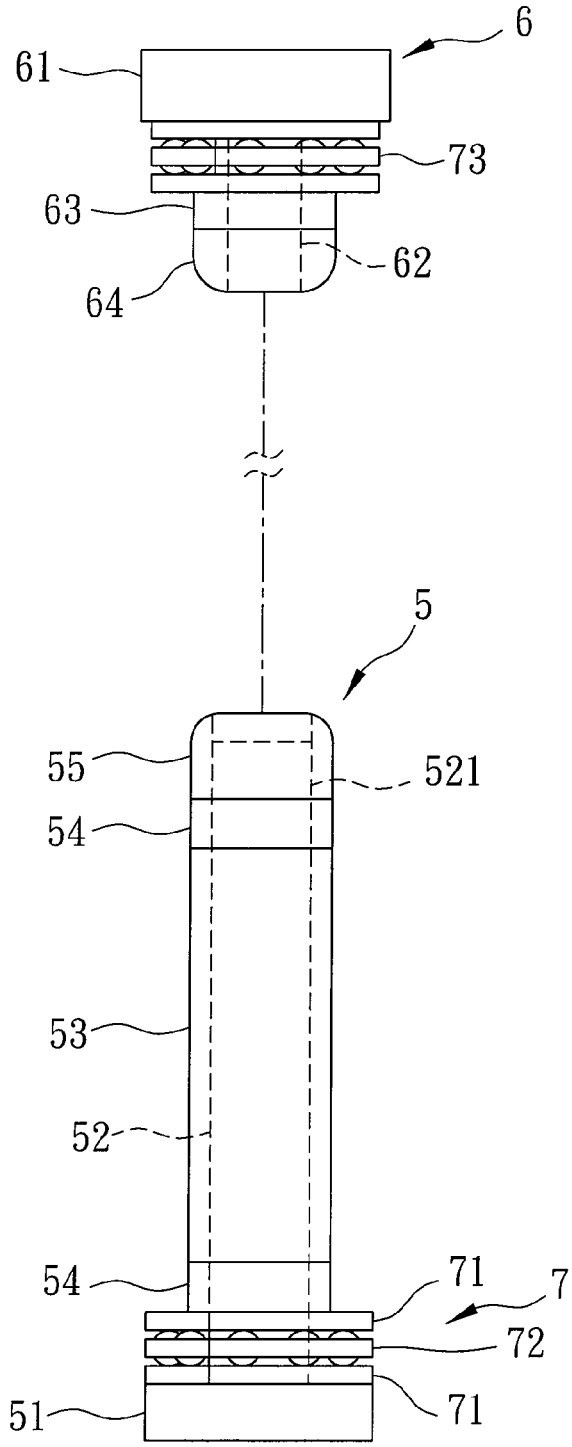
FIG. 6 is a schematic side view of the spring guiding mechanism.

With reference to FIGS. 4 to 6, the spring guiding mechanism includes a front anchor unit 6 disposed in the tubular wall 332, and a rear anchor unit 5 disposed in the rear sub-chamber (32*b*).

The front anchor unit 6 includes a front anchor stem 62 which has an enlarged portion 61 secured to the piston head 331 and which extends rearwardly along the stroke axis (X). A wear-resistant ring 63 is sleeved on the front anchor stem 62, and is in frictional contact with and angularly moveable relative to the front anchor stem 62. A front positioning nut 64 is threadedly engaged with a positioned end of the front anchor stem 62 to guard against axial movement of the wear-resistant ring 63 relative to the front anchor stem 62. Further, a front bearing unit 73 is interposed between the enlarged portion 61 and the wear-resistant ring 63 to improve the angular moveability of the wear-resistant ring 63. Preferably, the front anchor stem 62 is tubular so as not to obstruct the flow of the compressed air.

The rear anchor shank unit 5 has a core shank including an enlarged head segment 51 which is secured to the gun-rear end 322, and a shank segment 52 which extends forwardly from the enlarged head segment 51 along the stroke axis (X) to terminate at the positioned end region 521. A major shell 53 and first and second minor rings 54 are sleeved on the shank segment 52, and a positioning nut 55 is disposed to be threadedly engaged with the positioned end region 521 so as to guard against axial movement of the major shell 53 and the first and second minor rings 54 relative to the shank segment 52. The first and secondminor rings 54 are in frictional contact with and angularly moveable relative to the major shell 53, and are respectively disposed adjacent to the positioned end region 521 and the enlarged head segment 51. Further, a rear bearing unit 7 is interposed between the enlarged head segment 51 and the second minor ring 54 to improve the angular moveability of the second minor ring 54. In this embodiment, the rear bearing unit 7 includes two race plates 71 and a ball bearing interposed therebetween. According to this embodiment, each of the first and second minor rings 54 is made from a wear-resistant metal material, and the major shell 53 is made from a soundproof material, such as plastic, rubber, or the like.

The coil spring 4 is disposed in the accommodation chamber 32 to exert a biasing action to drive the piston head 331 of the piston member 33 to force the compressed air through the muzzle 323 when the coil spring 4 changes from a compressed state to a released state. The coil spring 4 includes a front coil segment 41 which is secured to the front anchor stem 62 and which is sleeved on the wear-resistant ring 63, and a rear coil segment 42 which extends rearwardly from the front coil segment 41, and which is configured to be sleeved on the first and second minor rings 54 and the major shell 53.

As mentioned above, when the spring-piston airsoft gun according to this embodiment is triggered, the coil spring 4 is released to expand to the released state. The rear coil segment 42 is tensed to drag the first and second minor rings 54 to move therewith angularly and, by virtue of the angular moveability of the first and second minor rings 54, a frictional force between the rear coil segment 42 and a respective one of the first and second minor rings 54 is minimized, thereby enhancing the wearability of the first and second minor rings 54. Meanwhile, the front coil segment 41 is tensed to drag the wear-resistant ring 63 to move therewith such that a frictional force therebetween is minimized by virtue of the angular moveability of the wear-resistant ring 63. By the front and rear bearing units 73, 7, the frictional force between the front coil segment 41 and the wear-resistant ring 63 and the frictional force between the rear coil segment 42 and the second minor ring 54 can be further reduced. Besides, since the first and second minor rings 54 are made from a wear-resistant metal material, and are rotatably sleeved on two sides of the shank segment 52 where larger friction will be generated during expansion of the coil spring 4, the wearing problem encountered in the use of the conventional anchor shank can be eliminated. Moreover, by virtue of the major shell 53 which is made from a soundproof material, the noise generated as a result of expansion of the coil spring 4 can be minimized. Furthermore, by means of the angularly moveability of the minor rings 54 and the wear-resistant ring 63 with the coil spring 4, the coil spring 4 can be expanded smoothly and successfully with little friction loss, thereby rendering driving of the piston member 33 effectively.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A spring-piston airsoft gun comprising:

a barrel extending along a stroke axis to terminate at a muzzle end and a gun-rear end, and defining an accommodation chamber which includes a front sub-chamber and a rear sub-chamber respectively proximate to said muzzle end and said gun-rear end;

a cylinder disposed in said front sub-chamber, and having a front end that is in fluid communication with said muzzle end, and an inner tubular wall surface that extends rearwardly from said front end along the stroke axis;

a piston member which includes a piston head configured to be fittingly received in said cylinder and in slidable contact with said inner tubular wall surface such that, when driven forward, said piston head forces air through said muzzle end to make a shooting action, and a tubular wall which extends rearwardly from said piston head along the stroke axis;

a front anchor stem disposed in said tubular wall, and extending from said piston head along the stroke axis;

a rear anchor shank unit which includes a core shank which is disposed in said rear sub-chamber, and which extends forwardly from said gun-rear end along the stroke axis to terminate at a positioned end region, a major shell which is sleeved on said core shank proximate to said gun-rear end, and a first minor ring which is sleeved on said core shank, which is in frictional contact with and angularly moveable relative to said major shell, and which is proximate to said positioned end region; and a coil spring disposed in said accommodation chamber to exert a biasing action to drive said piston head to force air through said muzzle end when said coil spring changes from a compressed state to a released state, and including a front coil segment which is secured to said front anchor stem, and a rear coil segment which extends rearwardly from said front coil segment, and which is configured to be sleeved on said first minor ring and said major shell such that, when said coil spring is released to expand to the released state, said rear coil segment is tensed to drag said first minor ring to move therewith angularly and, by virtue of the angular moveability of said first minor ring, a frictional force between said rear coil segment and said first minor ring is minimized, thereby enhancing the wearability of said first minor ring.

2. The spring-piston airsoft gun according to claim 1, wherein said rear anchor shank unit includes a second minor ring which is sleeved on said core shank, which is disposed between said major shell and said gun-rear end, and which is in frictional contact with and angularly moveable relative to said major shell.

3. The spring-piston airsoft gun according to claim 2, wherein said core shank includes an enlarged head segment which is secured to said gun-rear end, and a shank segment which extends forwardly from said enlarged head segment to terminate at said positioned end region such that said first and second minor rings are respectively disposed adjacent to said positioned end region and said enlarged head segment.

4. The spring-piston airsoft gun according to claim 3, wherein said rear anchor shank unit further includes a positioning nut which is configured to be threadedly engaged with said positioned end region so as to guard against axial movement of said major shell and said first and second minor rings relative to said core shank.

5. The spring-piston airsoft gun according to claim 4, further comprising a rear bearing unit which is interposed between said enlarged head segment and said second minor ring to improve the angular moveability of said second minor ring, thereby reducing a frictional force between said second minor ring and said rear coil segment.

6. The spring-piston airsoft gun according to claim 2, wherein each of said first and second minor rings is made from a wear-resistant metal material, and said major shell is made from a soundproof material.

7. The spring-piston airsoft gun according to claim 1, further comprising a wear-resistant ring which is sleeved on said front anchor stem, and which is in frictional contact with and angularly moveable relative to said front anchor stem, said front coil segment being sleeved on said wear-resistant ring such that, when said coil spring is released to expand to the released state, said front coil segment is tensed to drag said wear-resistant ring to move therewith such that a frictional force therebetween is minimized by virtue of the angular moveability of said wear-resistant ring.

8. The spring-piston airsoft gun according to claim 7, further comprising a front bearing unit interposed between said wear-resistant ring and said front anchor stem to improve the angular moveability of said wear-resistant ring, thereby reducing the frictional force between said front coil segment and said wear-resistant ring.

9. The spring-piston airsoft gun according to claim 1, wherein said front anchor stem is tubular.

* * * * *